US006637211B1

(12) United States Patent
Swift et al.

(10) Patent No.: US 6,637,211 B1
(45) Date of Patent: Oct. 28, 2003

(54) CIRCULATING HEAT EXCHANGERS FOR OSCILLATING WAVE ENGINES AND REFRIGERATORS

(75) Inventors: Gregory W. Swift, Santa Fe, NM (US); Scott N. Backhaus, Espanola, NM (US)

(73) Assignee: The Regents of the University of California, Los Alamos, NM (US)

( * ) Notice: Subject to any disclaimer, the term of this patent is extended or adjusted under 35 U.S.C. 154(b) by 0 days.

(21) Appl. No.: 10/218,960

(22) Filed: Aug. 13, 2002

(51) Int. Cl.[7] ..... F25B 9/00
(52) U.S. Cl. ..... 62/6; 60/520
(58) Field of Search ..... 62/6; 60/520

(56) References Cited

U.S. PATENT DOCUMENTS 4,412,418 A * 11/1983 Beale ..... 60/520
5,303,275 A * 4/1994 Kobsa ..... 376/352
5,966,942 A * 10/1999 Mitchell ..... 62/6
6,109,041 A * 8/2000 Mitchell et al. ..... 62/6
6,314,740 B1 * 11/2001 De Blok et al. ..... 62/6

* cited by examiner

*Primary Examiner*—William C. Doerrler
(74) *Attorney, Agent, or Firm*—Ray G. Wilson

(57) ABSTRACT

An oscillating-wave engine or refrigerator having a regenerator or a stack in which oscillating flow of a working gas occurs in a direction defined by an axis of a trunk of the engine or refrigerator, incorporates an improved heat exchanger. First and second connections branch from the trunk at locations along the axis in selected proximity to one end of the regenerator or stack, where the trunk extends in two directions from the locations of the connections. A circulating heat exchanger loop is connected to the first and second connections. At least one fluidic diode within the circulating heat exchanger loop produces a superimposed steady flow component and oscillating flow component of the working gas within the circulating heat exchanger loop. A local process fluid is in thermal contact with an outside portion of the circulating heat exchanger loop.

10 Claims, 10 Drawing Sheets

CIRCULATING HEAT EXCHANGERS FOR OSCILLATING WAVE ENGINES AND REFRIGERATORS

STATEMENT REGARDING FEDERAL RIGHTS

This invention was made with government support under Contract No. W-7405-ENG-36 awarded by the U.S. Department of Energy. The government has certain rights in the invention.

FIELD OF THE INVENTION

The present invention relates generally to oscillating wave engines and refrigerators, and, more particularly, to Stirling engines, Stirling refrigerators, orifice pulse tube refrigerators, thermoacoustic engines, thermoacoustic refrigerators, and hybrids and combinations thereof.

BACKGROUND OF THE INVENTION

Historically, Stirling's hot-air engine of the early 19th century was the first heat engine to use oscillating pressure and oscillating volume flow rate in a working gas in a sealed system, although the time-averaged product thereof was not called acoustic power. Since then, a variety of related engines and refrigerators have been developed, including Stirling refrigerators, Ericsson engines, orifice pulse-tube refrigerators, standing-wave thermoacoustic engines and refrigerators, free-piston Stirling engines and refrigerators, and thermoacoustic-Stirling hybrid engines and refrigerators. Combinations thereof, such as the Vuilleumier refrigerator and the thermoacoustically driven orifice pulse tube refrigerator, have provided heat-driven refrigeration.

Much of the evolution of this entire family of acoustic-power thermodynamic technologies has been driven by the search for higher efficiencies, greater reliabilities, and lower fabrication costs. FIGS. 1, 2, and 3 show some prior art engine examples in which simplicity, reliability, and low fabrication costs have been achieved by the elimination of moving parts, especially elimination of moving parts at temperatures other than ambient temperature.

FIG. 1 shows a free-piston Stirling engine 10 integrated with a linear alternator 12 to form a heat-driven electric generator. High-temperature heat, such as from a flame or from nuclear fuel, is added to the engine at hot heat exchanger 14, ambient-temperature waste heat is removed from the engine at ambient heat exchanger 16, and oscillations of working gas 18, piston 22, and displacer 24 are thereby encouraged. The oscillations of piston 22 cause permanent magnet 26 to oscillate through wire coil 28, thereby generating electrical power, which is removed from the engine to be used elsewhere.

The conversion of heat to acoustic power occurs in regenerator 32, which is a solid matrix smoothly spanning the temperature difference between hot heat exchanger 14 and ambient heat exchanger 16 and containing small pores through which working gas 18 oscillates. The pores must be small enough that working gas 18 in the pores is in is excellent local thermal contact with the solid matrix. Proper design of the dynamics of moving piston 22 and displacer 24, their gas springs 34/36, and working gas 18 throughout the system causes the working gas in the pores of regenerator 32 to move toward hot heat exchanger 14 while the pressure is high and toward ambient heat exchanger 16 while the pressure is low. The oscillating thermal expansion and contraction of the working gas in regenerator 32, attending its oscillating motion along the temperature gradient in the pores, is therefore temporally phased with respect to the oscillating pressure so that the thermal expansion occurs while the pressure is high and the thermal contraction occurs while the pressure is low.

The absence of crankshafts and connecting rods contributes to the simplicity, reliability, and low fabrication costs of the free-piston Stirling engine.

FIG. 2 shows a "toroidal" regenerator-based engine: a thermoacoustic-Stirling hybrid engine delivering acoustic power to an unspecified load 42 (e.g., a linear alternator or any of the aforementioned refrigerators) to the right. See, e.g., U.S. Pat. No. 6,032,464, "Traveling Wave Device with Mass Flux Suppression, issued Mar. 7, 2000, to Swift et al. and U.S. Pat. No. 6,314,740, "Thermoacoustic System," issued Nov. 13, 2001, to deBlok et al. High-temperature heat, such as from a flame, from nuclear fuel, or from ohmic heating, is added to the engine at hot heat exchanger 44, most of the ambient-temperature waste heat is removed from the engine at main ambient heat exchanger 46, and oscillations of the working gas are thereby encouraged. Mass flux suppressor 50 acts to minimize time-averaged mass flux of the working gas and attendant heat loss. The oscillations deliver acoustic power to load 42.

FIG. 3 shows a "cascade" thermoacoustic-Stirling hybrid engine comprising a standing-wave thermoacoustic engine and a Stirling engine in series, without any piston therebetween, as described in U.S. patent application Ser. No. 10/125,268 "Cascaded Thermoacoustic Devices," G. W. Swift et al., filed Apr. 18, 2002. High-temperature heat is added at the two hot heat exchangers 52, 54; ambient-temperature waste heat is removed at the three ambient heat exchangers 56, 58, 62; and oscillations of the working gas are thereby encouraged. The oscillations deliver acoustic power to a load 64, such as a linear alternator or a pulse tube refrigerator, below the bottom of FIG. 3. The conversion of heat to acoustic power occurs in regenerator 66 according to the same processes as described in the context of FIG. 1 above. Stack 68 has larger pore sizes than regenerator 66, and conversion of heat to acoustic power in stack 68 occurs by a similar process, but with some different details regarding time phasing, as described in the '268 patent application.

The simplicity, reliability, and low fabrication cost of the toroidal thermoacoustic-Stirling hybrid engine and of the cascade thermoacoustic-Stirling hybrid engine, compared to earlier Stirling engines, comes from the elimination of pistons previously needed.

FIG. 4A shows a piston-driven orifice pulse tube refrigerator, as described for example by R. Radebaugh in "A review of pulse tube refrigeration," Adv. Cryogenic Eng., volume 35, pages 1191–1205 (1990). The motion of piston 70 causes oscillations in the working gas throughout the refrigerator. Low-temperature heat is removed from a load by the refrigerator at cold heat exchanger 72, and ambient-temperature waste heat is rejected from the refrigerator at the two ambient-temperature heat exchangers 74, 76, the larger of which is commonly called the aftercooler, i.e., heat exchanger 74. Heat pumping up the temperature gradient occurs in regenerator 78 because the working gas in the pores of regenerator 78 is caused to move toward cold heat exchanger 72 while the pressure is high and toward aftercooler 74 while the pressure is low. This necessary time phasing between oscillating pressure and oscillating motion is created by acoustic impedance network 82 above pulse tube 84, which sets the relative amplitudes and time phasing of the pressure and velocity at its entrance. Earlier Stirling refrigerators achieved the correct time phasing by means of a cold piston (whose motion was coordinated with that of the drive piston) instead of by means of the acoustic impedance network. However, the technical challenge of sealing around such a piston at cryogenic temperatures was severe. Hence, the simplicity, reliability, and low fabrication cost of the orifice pulse tube refrigerator compared to earlier Stirling refrigerators comes from the elimination of the cold piston.

Although much progress has recently been made in the elimination of moving parts from these oscillating-wave engines and refrigerators, the simplification of the heat exchangers offers a second opportunity for dramatic improvement in simplicity, reliability, and low fabrication cost, particularly in engines and refrigerators of high power. All engines and refrigerators must reject waste heat to ambient temperature, and the ambient temperature is often present as a flowing fluid stream, such as a fan-driven air stream or a flowing water stream. Engines must also accept heat from a source at a higher temperature, which may be in the form of a flowing stream of combustion products from a burner. Refrigerators must withdraw heat from a load at lower temperature, which is sometimes in the form of a flowing stream; examples include a stream of indoor air to be cooled and dehumidified, or a stream of methane to be cooled and cryogenically liquefied. Hence, the typical heat exchanger in these engines and refrigerators must transfer heat between a steadily flowing "process fluid" stream and an oscillating "working gas" stream that is the thermodynamic working substance of the oscillating-wave engine or refrigerator. The working gas is often pressurized helium gas. At small power levels, simple geometries such as stacks of copper screens suffice as heat exchangers, but at higher powers the thermal conductivity of solids is insufficient to carry the required heats, so that geometrically complicated heat exchangers must usually be used to bring the process fluid and working gas into intimate thermal contact.

M. Mitchell, "Pulse tube refrigerator," U.S. Pat. No. 5,966,942, Oct. 19, 1999, teaches a design to avoid a geometrically complicated heat exchanger for the ambient heat exchanger 76 (FIG. 4A) at the ambient end of the pulse tube 84 of an orifice pulse tube refrigerator. As illustrated in FIG. 4B, which is adapted from FIGS. 1 and 11 in the '942 patent, ambient heat exchanger 76 and orifice 86 can be replaced by a dissipative heat-transfer loop 88 containing one or more (two are shown in FIG. 4B) fluidic diodes 92, 94 that convert some of the oscillatory power in the oscillating wave into circulating flow of the working gas around loop 88. The dissipation in fluidic diodes 92,94 and other oscillatory dissipation in loop 88 serve the function of orifice 86, and the surface area along the entire path length of loop 88 serves the function of heat exchanger 76.

A shell and tube heat exchanger 102, illustrated in FIGS. 5A and 5B, is typical of the complicated, geometries that must otherwise be used at high power throughout oscillating-wave engines and refrigerators. Working gas 104 oscillates through the insides of the many tubes 106, while process fluid 108 flows around and between the outsides of tubes 106.

Particular features of oscillating-wave engines and refrigerators impose size constraints on such heat exchangers as they are scaled up to higher powers. Higher power demands more heat-transfer surface area for efficient heat transfer. However, tube diameters cannot be increased, because this would reduce the total heat-transfer coefficient on the working-gas side, thereby decreasing the efficiency. Tube lengths cannot be increased, because having such tube lengths greater than the oscillatory displacement of the working gas does not help transfer more heat.

The usual solution to the scaleup of heat exchangers is to increase the number of tubes in proportion to the power, keeping the length and diameter of each tube constant. Such heat exchangers can have hundreds or thousands of tubes. Building such heat exchangers is expensive (because many parts must be handled, assembled, and joined) and such heat exchangers are unreliable (because so many joints must be leak tight). Thermally induced stress imposes an additional challenge to reliability when a geometrically complex heat exchanger is at an extreme temperature, such as a red-hot temperature for an engine or a cryogenic temperature for a refrigerator. Sometimes a pool boiler or heat pipe must be used to enforce isothermality in these circumstances so that thermally induced stresses are eliminated.

Another shortcoming of oscillating-wave engines and refrigerators is that their heat exchangers often must be located close to one another, simply because each heat exchanger must typically be adjacent to one end or the other of the nearest stack or regenerator or pulse tube or thermal buffer tube, and these components themselves are typically short. The practical importance of this shortcoming is easily appreciated by considering the food refrigerator in the typical American kitchen. The "vapor compression" (also known as "reverse Rankine") cooling technology employed therein allows complete flexibility in the geometrical separation of the cold heat exchanger, where heat is absorbed from the inside of the cold box, and the ambient heat exchanger, where waste heat is rejected outside, to the air in the kitchen. The cold heat exchanger is typically located inside, above, or under the freezer, and the ambient heat exchanger is typically located behind or under the refrigerator cabinet. Not only can these heat exchangers be located freely, but their shapes can be chosen as needed for their circumstances, e.g., to accommodate fan-driven or natural convection as chosen, and to fit in and around the desired shape of the cold box or cabinet. In contrast, when one tries to adapt an oscillating-wave refrigerator to this application, the cold heat exchanger and main ambient heat exchanger must be very close together, separated only by the regenerator whose length is typically only a few inches. Hence, in, order to put the cold heat exchanger and the main ambient heat exchanger into thermal contact with the inside of the cold box and with the outside air, respectively, intermediate heat transfer means, such as heat pipes or pumped fluid heat transfer loops, must typically be employed. These add complexity and cost, and reduce efficiency.

Accordingly, it is highly desirable to provide simplicity, reliability, and low fabrication cost of heat exchangers for oscillating-wave engines and refrigerators. More specifically, the present invention is directed to eliminating the need for massively parallel heat-exchanger structures in oscillating-wave engines and refrigerators of high power. The present invention also allows the heat exchangers of oscillating-wave engines and refrigerators to be located distant from one another and from the nearest regenerator or stack.

Those skilled in the art understand that "ambient" temperature, referring to the temperature at which waste heat is rejected, need not always be a temperature near ordinary room temperature. For example, a cryogenic refrigerator intended to liquefy hydrogen at 20 Kelvin might reject its waste heat to a liquid-nitrogen stream at 77 Kelvin; for the purposes of this particular cryogenic refrigerator, "ambient" would be 77 Kelvin.

Those skilled in the art also understand that fluidic diodes are typically much less perfect than electronic diodes. Fluidic diodes usually offer a difference between forward and backward flow resistances of less than a factor of ten, and sometimes even less than a factor of two, whereas the difference in forward and backward resistances in electronic diodes is typically orders of magnitude. Fluidic diodes include the vortex diodes described in '942, the valvular conduit described by Nikola Tesla in U.S. Pat. No. 1,329,559, Feb. 3, 1920, and the conical and tapered structures called jet pumps in many recent publications such as U.S. Pat. No. 6,032,464, "Traveling Wave Device with Mass Flux Suppression," supra; S. Backhaus, et al., "A thermoacoustic-Stirling heat engine: Detailed study," J. Acoust. Soc. Am., volume 107, pages 3148–3166 (2000); G. W. Swift, *Thermoacoustics: A unifying perspective for some engines and refrigerators*, to be published by The Acoustical Society of America, 2002.

Various objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

The present invention is directed to an oscillating-wave engine or refrigerator having a regenerator or a stack in which oscillating flow of a working gas occurs in a direction defined by an axis of a trunk of the engine or refrigerator, and having an improved heat exchanger. First and second connections branch from the trunk at locations along the axis in selected proximity to one end of the regenerator or stack, where the trunk extends in two directions from the locations of the connections. A circulating heat exchanger loop is connected to the first and second connections. At least one fluidic diode within the circulating heat exchanger loop produces a superimposed steady flow component and oscillating flow component of the working gas within the circulating heat exchanger. A local process fluid is in thermal contact with an outside portion of the circulating heat exchanger loop.

BRIEF DESCRIPTION OF THE DRAWINGS

The accompanying drawings, which are incorporated in and form a part of the specification, illustrate embodiments of the present invention and, together with the description, serve to explain the principles of the invention. In the drawings.

DETAILED DESCRIPTION

Figure 1:
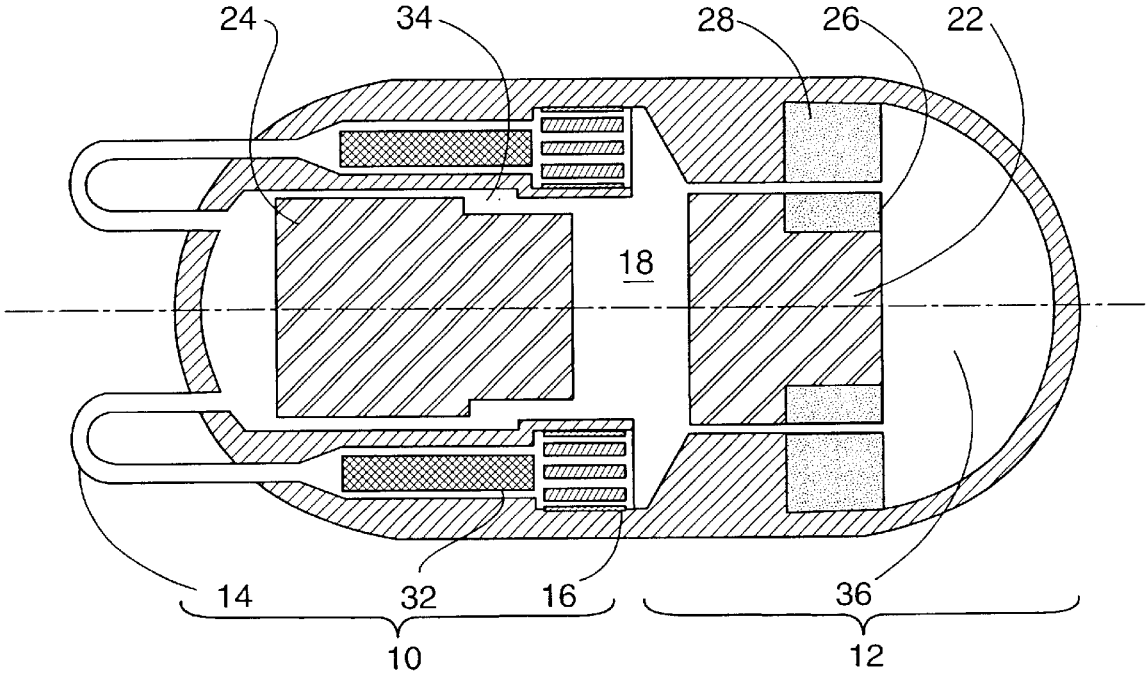
Fig. 1 (Prior Art)
FIG. 1 is a cross-sectional view of a free piston Stirling engine. (Prior art)
Figure 2:
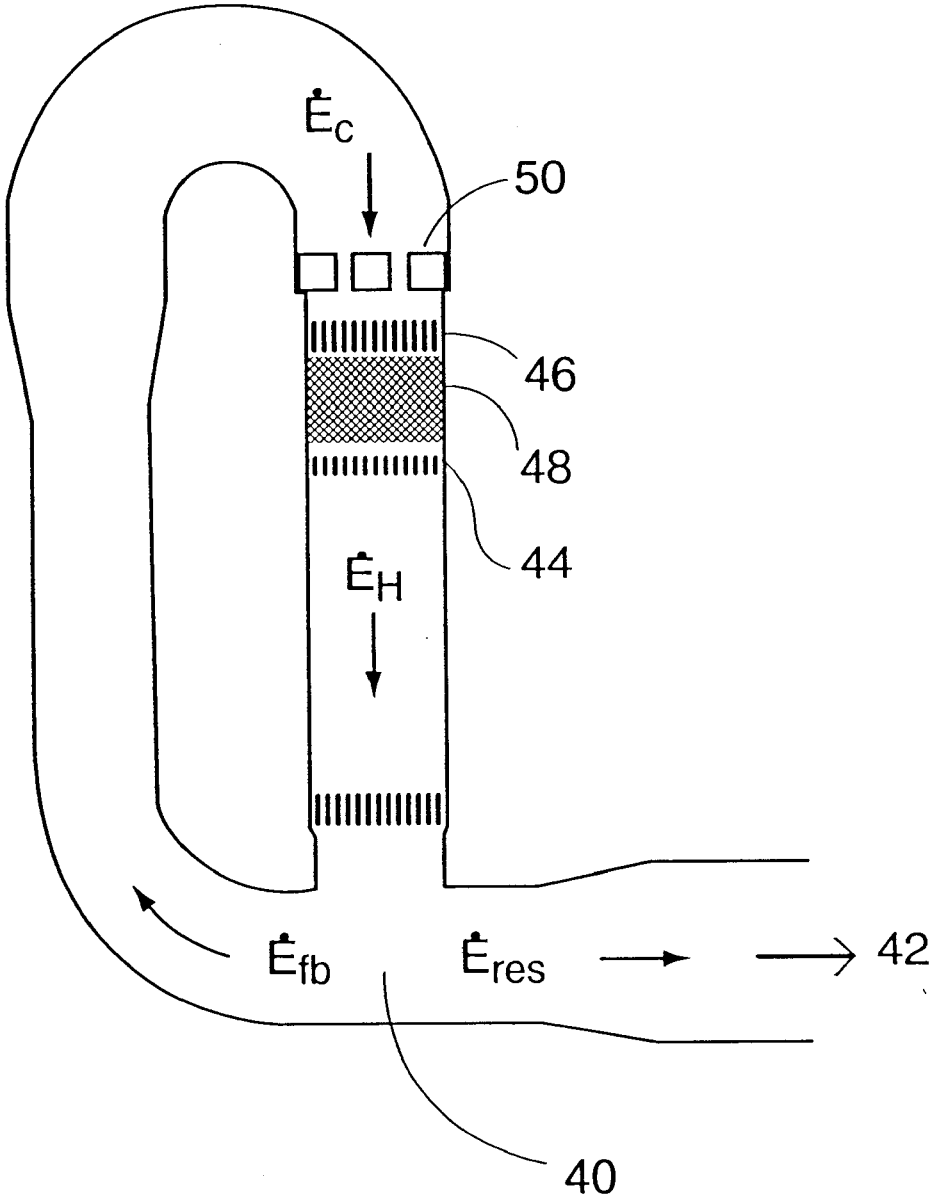
Fig. 2 (Prior Art)
FIG. 2 schematically depicts a toroidal thermoacoustic-Stirling hybrid engine. (Prior art)
Figure 3:
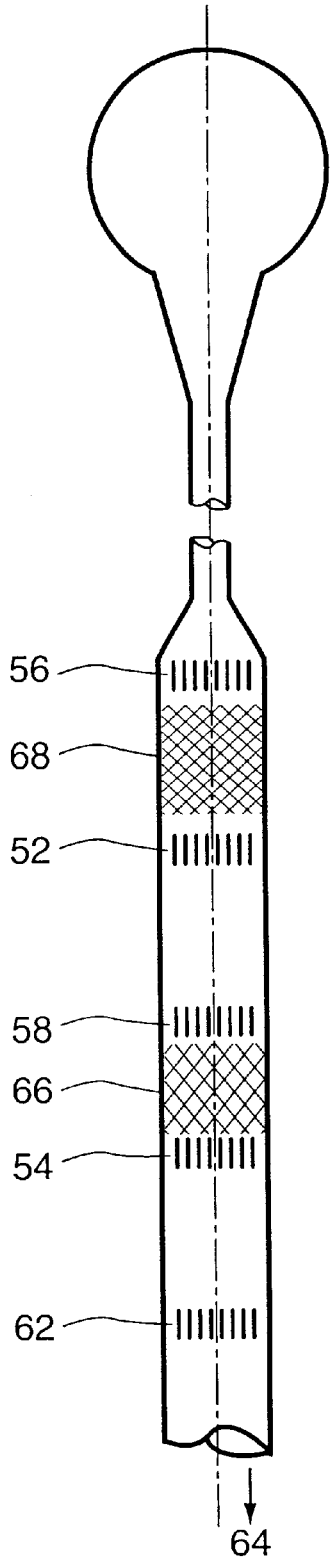
Fig. 3 (Prior Art)
FIG. 3 schematically depicts a cascade thermoacoustic-Stirling hybrid engine. (Prior art)

The improved heat exchanger of the present invention is generally explained with reference to FIGS. 6A and 6B. FIG. 6A shows a portion of an oscillating-wave engine or refrigerator 112, containing a prior art heat exchanger 114 as described above. In FIG. 6A, heat exchanger 114 is below stack or regenerator 116, and is above pulse tube, thermal buffer tube or open duct 118. Heat exchanger 114 is of traditional design, such as shell-and-tube or finned tube. The oscillating flow 122 of the working gas, e.g. pressurized helium, is indicated by the double-headed straight-line arrows. The steady flow 124 of the process fluid, e.g., water, is indicated by the wavy arrows. The axial direction along which these oscillations occur in regenerator/stack 116 and pulse tube/thermal buffer tube/open duct 118 is referred to herein as "the axis" and vessel 120 containing these components is referred to herein as "the trunk," where the trunk extends in two directions from regenerator or stack 116, and pulse tube/open duct/thermal buffer tube 118.

Figure 6B:
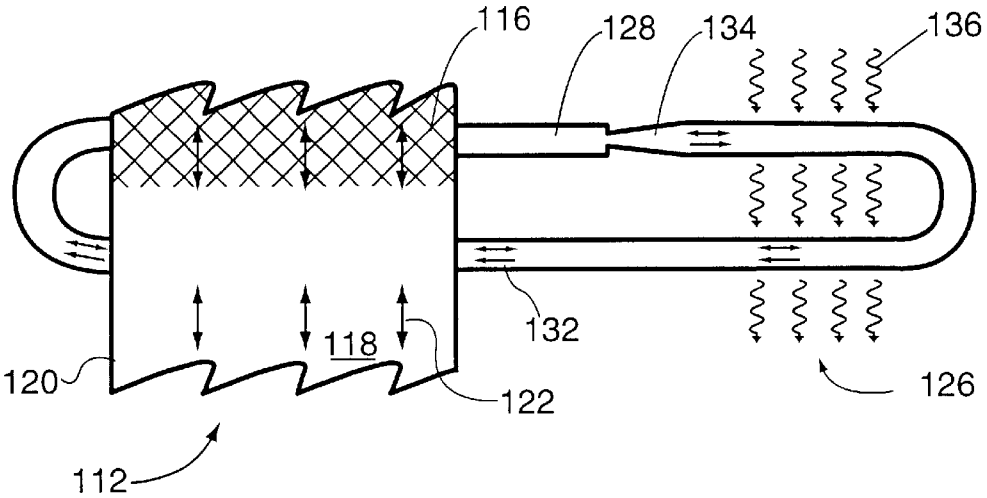
FIG. 6B schematically depicts a portion-of an oscillating-wave engine or refrigerator, employing a circulating heat exchanger according to the present invention.
Figure 6A:
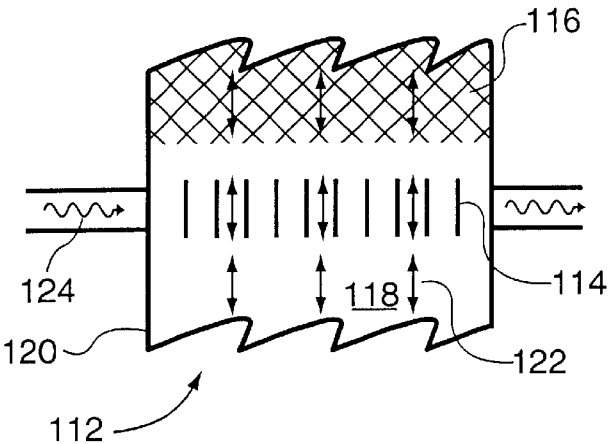
FIG. 6A schematically depicts a portion of an oscillating-wave engine or refrigerator. (Prior art)

FIG. 6B shows the same portion 112 of an oscillating-wave engine or refrigerator, but with a circulating heat exchanger 126 according to the present invention. Circulating heat exchanger 126 comprises a long, narrow pipe 128, each end of which is attached to trunk 120 at an axial location between stack/regenerator 116 and pulse tube/thermal buffer tube/or open duct 118. The preferred axial location is where a prior-art heat exchanger would be expected. Oscillating flow 122 of the working gas in trunk 120 is again indicated by the double-headed straight-line arrows.

The flow 132 of the working gas in circulating heat exchanger 126 is a superposition of oscillating flow and steady flow, indicated by adjacent double-headed straight-line arrows and single-headed straight-line arrows. The steady flow therein is caused by the interaction of the oscillating flow with fluidic diode 134 and is in the direction of least resistance through fluidic diode 134. In turn, the oscillating flow in circulating heat exchanger 126 is caused by the pressure oscillations in trunk 120. The steady flow of the process fluid is again indicated by the wavy arrows. Process fluid 136 flows past circulating heat exchanger 126 (either substantially perpendicular to it, as shown in FIG. 6B, or substantially parallel to it, or anything in between).

Thus, heat exchanger 114 of FIG. 6A, which is expensive to build because it comprises a multiplicity of parallel passages, and which must abut regenerator or stack 116, has been replaced by circulating heat exchanger 126 shown in FIG. 6B, which is inexpensive because it is essentially just a single long pipe, and which allows the heat exchange between the working gas and process fluid 136 to take place far from regenerator or stack 116.

Figure 4B:
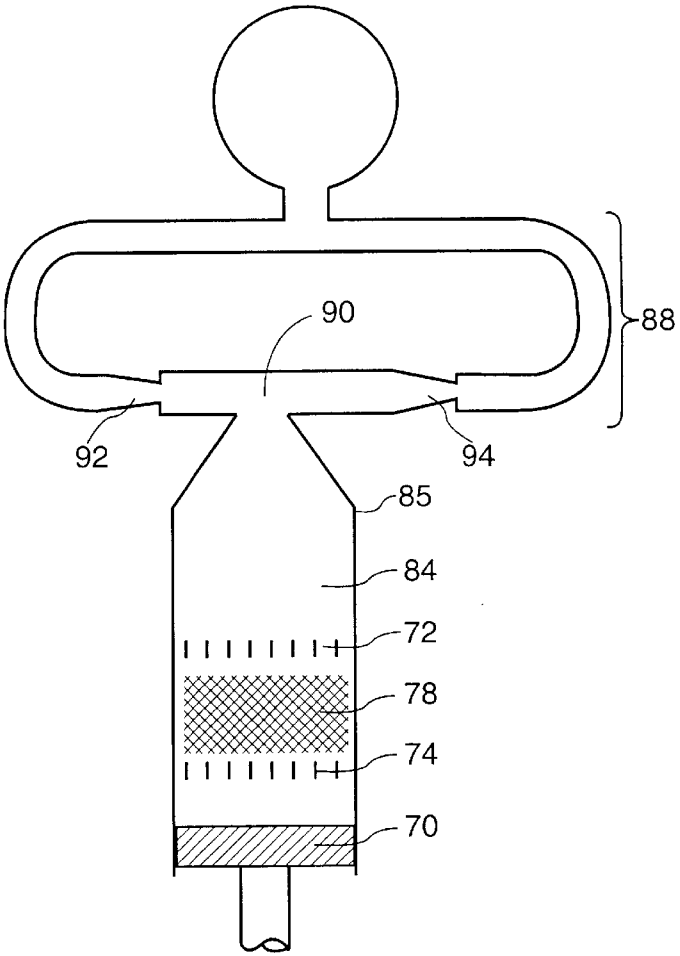
Fig. 4B (Prior Art)
FIG. 4B schematically depicts an orifice pulse tube refrigerator with heat-transfer loop at the ambient end of the pulse tube driven by a fluidic diode. (Prior art)
Figure 4A:
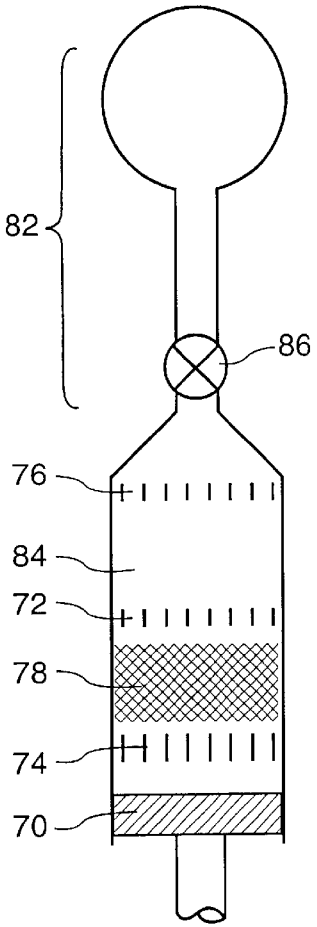
Fig. 4A (Prior Art)
FIG. 4A schematically depicts an orifice pulse tube refrigerator. (Prior art)
Figure 5A:
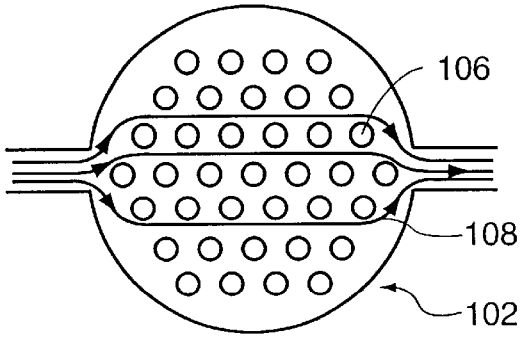
FIGS. 5A and 5B schematically depict a conventional shell-and-tube heat exchanger. (Prior art)
Figure 5B:
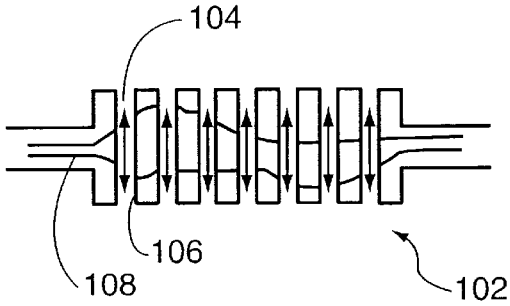

The distinction between the invention shown in FIG. 6B and the fluidic diode configuration shown by the '942 patent (FIG. 4B) is the topology. As shown in FIG. 4B, vessel 85 terminates at tee 90, while trunk 120 of the present invention extends in both directions from circulating heat exchanger 126. Heat-transfer loop 88 in FIG. 4B carries all of the oscillating flow that exists in vessel 85. In contrast, circulating heat exchanger 126 in FIG. 6B carries only a fraction of the oscillating flow in trunk 120, that fraction designed to be as small as possible. The '942 patent teaches only the context of the heat exchanger at the warm end of the pulse tube in a pulse tube refrigerator, which is a unique location in a specific type of oscillating-wave refrigerator where all of the trunk flow can indeed be carried by the two branches together, without harm to the function of the refrigerator. In contrast, the present invention is applicable to any of the heat exchangers of any oscillating-wave engine or refrigerator.

Figure 8B:
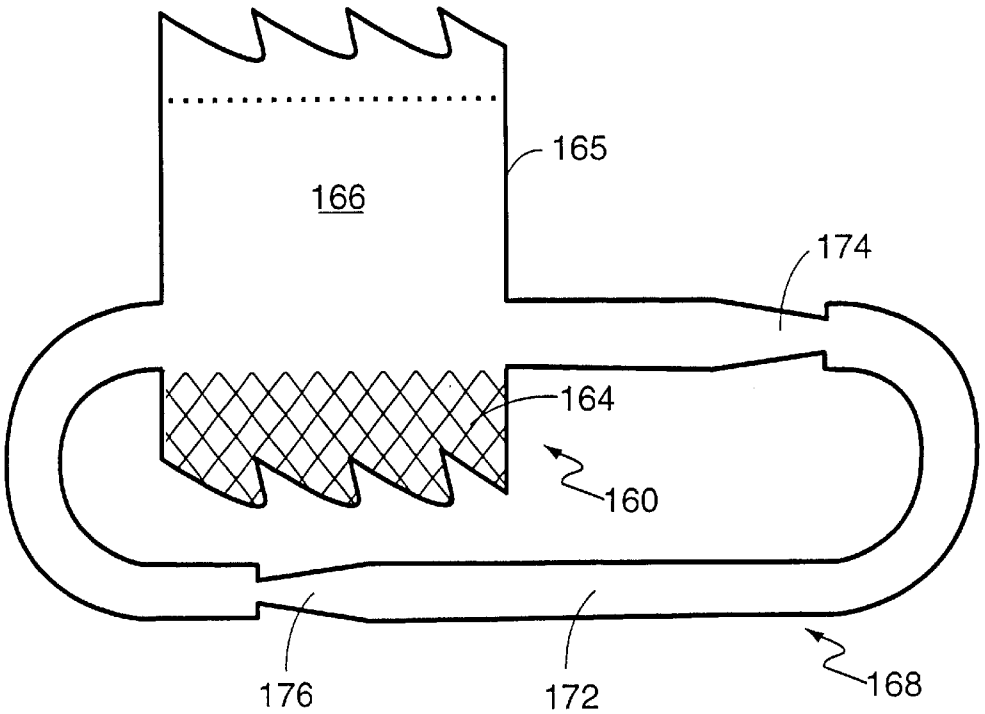
FIG. 8B schematically depicts a portion of an oscillating-wave refrigerator, employing a resonant circulating cold exchanger according to the present invention.
Figure 8A:
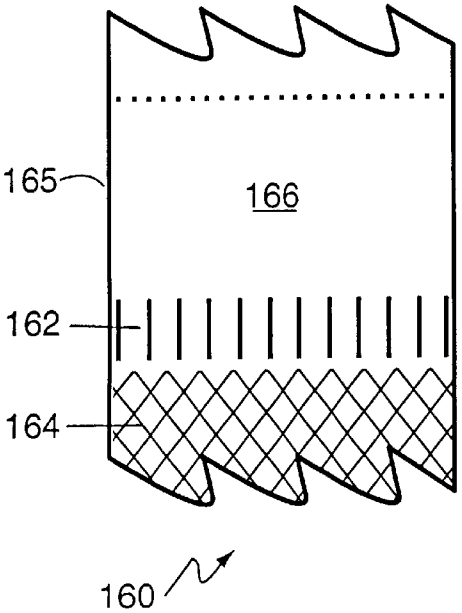
Fig. 8a (Prior Art)
FIG. 8A schematically depicts a portion of an oscillating-wave refrigerator. (Prior art)
Figure 9B:
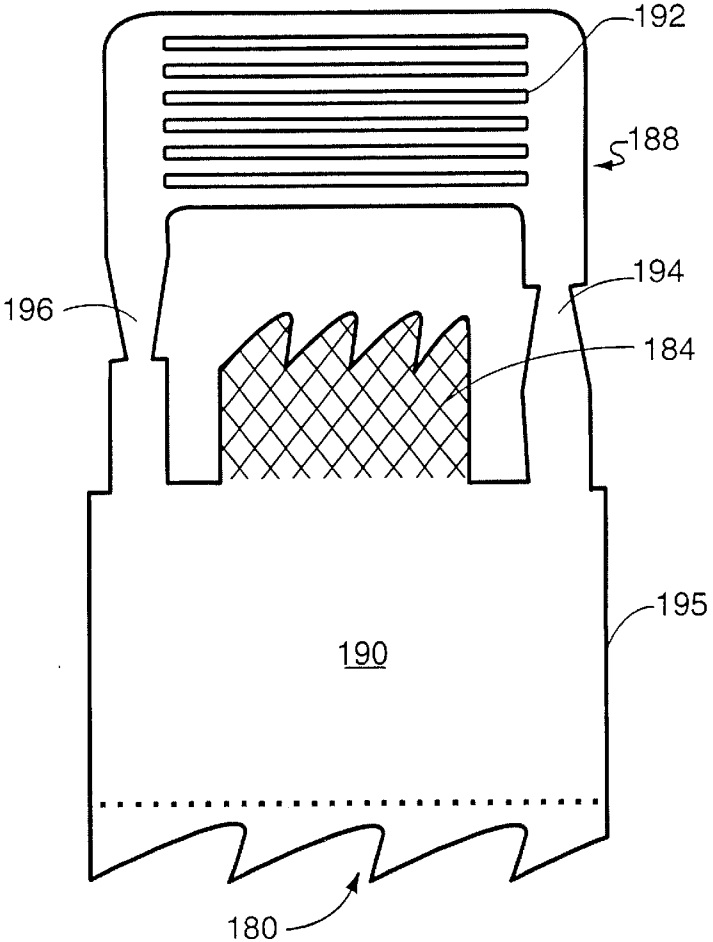
FIG. 9B schematically depicts a portion of an oscillating-wave engine, employing a non-resonant circulating hot heat exchanger according to the present invention.
Figure 9A:
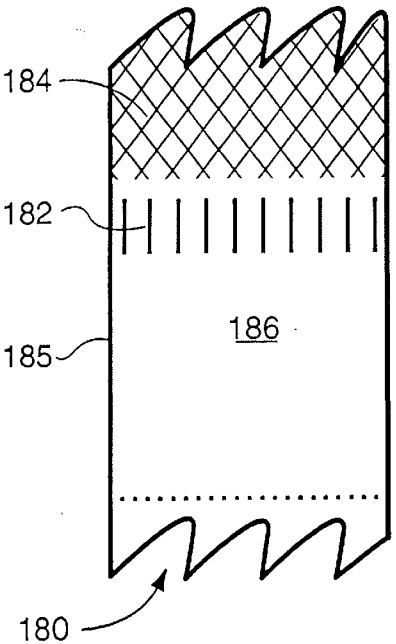
Fig. 9a (Prior Art)
FIG. 9A schematically depicts a portion of an oscillating-wave engine. (Prior art)

Referring first to a resonant embodiment of the present invention, the oscillating flow in the trunk is perturbed only a small amount, while creating a surprisingly strong steady flow in the circulating heat exchanger. Resonant embodiments are described in the context of hot heat exchangers 142 and 146 of oscillating-wave engine 140, shown in FIGS. 7A and 7B, and in the context of cold heat exchangers 162 and 168 of oscillating-wave refrigerator 160 shown in FIGS. 8A and 8B. A non-resonant embodiment of the is present invention perturbs the oscillating flow in the trunk considerably, leading in some situations to a requirement for a larger pulse tube or thermal buffer tube. A non-resonant embodiment is described in the context of the hot heat exchanger of an oscillating-wave engine as shown in FIGS. 9A and 9B.

Figure 7B:
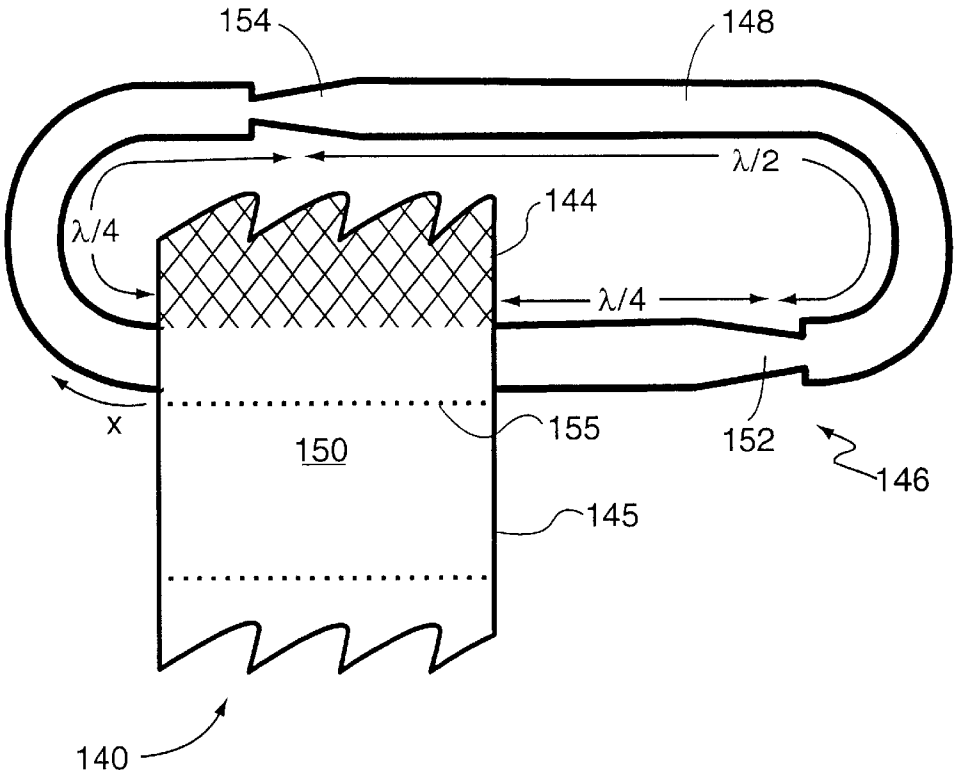
FIG. 7B schematically depicts a portion of an oscillating-wave engine, employing a resonant circulating hot heat exchanger according to the present invention.
Figure 7A:
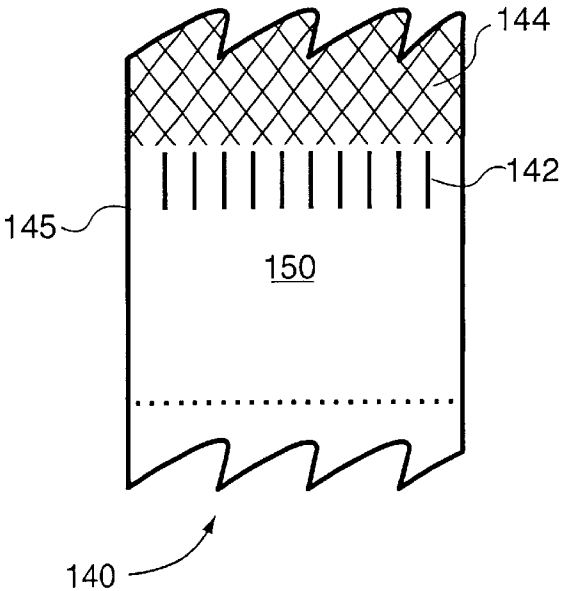
Fig. 7a (Prior Art)
FIG. 7A schematically depicts a portion of an oscillating-wave engine. (Prior art)

A resonant embodiment of the present invention is illustrated with reference to FIGS. 7A and 7B. FIG. 7A shows a portion of an oscillating-wave engine 140, employing a traditional hot heat exchanger 142, such as a shell-and-tube heat exchanger, located adjacent to regenerator/stack 144 contained within trunk 145. FIG. 7B shows the use of a resonant circulating hot heat exchanger 146 according to the present invention, instead of traditional hot heat exchanger 142. Resonant circulating hot heat exchanger 146 comprises pipe 148 with a length equal to one wavelength of sound in the working gas, at the frequency of the oscillation of the working gas, and has two fluidic diodes 152, 154 in pipe 148, each located a quarter wavelength from an end of pipe 148. The wavelength is that of the working gas at the temperature in pipe 148, which, might be far from ambient temperature.

The oscillating and steady flows of the working gas, and the steady flow of the process fluid (here, a hot gas such as the combustion products from a burner) are similar to the flows shown in FIGS. 6A and 6B. However, the fact that the oscillating flow is wavelike in character and the fact that the length of pipe 148.in FIG. 7B is one wavelength of sound lead to some unexpected synergistic features. Fluidic diodes 152, 154 are located where the oscillating volume flow rate is a maximum along pipe 148 so that fluidic diodes 152, 154 can create a large steady flow, as explained more fully below. Meanwhile, the ends of pipe 148 are locations of minimal oscillating volume flow rate of working gas within pipe 148, so that connecting pipe 148 to trunk 145 only minimally perturbs the oscillations in trunk 145. Thus, circulating heat exchanger 146 extracts from and delivers to trunk 145 a large steady flow, while only minimally perturbing oscillations in trunk 145.

One specific design of this type for an engine has been further investigated, with a hot heat exchanger 142 or 146 required between regenerator 144 above hot heat exchanger 142 or 146 and a thermal buffer tube 150 below, as shown in FIGS. 7A and 7B. The engine operates at 40 Hz, with a helium working gas at an average pressure of 3.1 MPa. The design with traditional heat exchanger 142, as shown in FIG. 7A, is compared with the design with circulating heat exchanger 146, as shown in FIG. 7B.

The geometry of the traditionally designed heat exchanger 142 is shell-and-tube. Heat exchanger 142 was designed to deliver 63 kW of heat to the engine, keeping the hot, lower face of regenerator 144 at 936 K. Heat exchanger 142 comprised 375 tubes in parallel, each having a length of 20 cm and an inside diameter of 6 mm, so that the total surface area presented to the helium was 1.5 square meters. The amplitude of the oscillating pressure in the helium in and near heat exchanger 142 was 240 kPa, and 2.7 kW of acoustic power was consumed in viscous and thermal-hysteresis loss in heat exchanger 142, while 55 kW of acoustic power passed through it. Even with this much surface area, it was estimated that a 40 degree average difference in temperature is required to drive the heat from the metal into the helium. This would be a very complex heat exchanger to fabricate because the high temperature weakens metals and the difficulty of ensuring tube-to-tube temperature uniformity as the combustion-product process fluid flows through the shell is extreme.

The geometry of the circulating heat exchanger 146 for this application is illustrated in FIG. 7B: pipe 148 one wavelength long, with two fluidic diodes 152, 154 at the quarter-wavelength positions. Circulating heat exchanger 146 was, as above, designed to deliver 63 kW of heat to the engine, keeping the hot, lower face of regenerator 144 at 936 K. The amplitude of the oscillating pressure in the helium working gas below regenerator 144 was 240 kPa, while 55 kW of acoustic power passed down from regenerator 144, as above. Heat exchanger 146 comprised one pipe 148, having a length of 43 m, and an inside diameter of 7.1 cm, so that the total surface area presented to the helium working gas was 10 square meters.

The dramatic increase in surface area of circulating heat exchanger 146 relative to traditional heat exchanger 142 means that temperature differences, both process fluid to metal and metal to helium, are greatly reduced, as long as the steady flow is vigorous and the heat transfer coefficient per unit area is reasonably large. The long length of pipe 148 means that some length can be devoted to tubing runs without heat exchange, in order to place the heat exchanger at a convenient location remote from the regenerator, where the heat-exchange portion of pipe 148 can be coiled for compactness. Each of the two fluidic diodes 152, 154 is a truncated cone, with the large end matched to pipe 148 and the small end having an area equal to 40% of the area of pipe 148, and with a length of 43 cm. The lip at the abrupt diametral transition from the small-diameter end of the cone back to the pipe diameter is preferably generously rounded so that the minor loss coefficient for flow into the small end, $K_{in}$, is approximately 0.05 or less (see, e.g., *Introduction to Fluid Mechanics*, R. W. Fox and A. T. McDonald (Wiley, 1985)).

The dissipation of acoustic power in circulating heat exchanger 146 was estimated to be 7.6 kW total, with 1.9 kW lost in fluidic diodes 152, 154 and 5.7 kW of viscous and thermal-hysteresis losses elsewhere in pipe 148. The extra 4.9 kW of acoustic power dissipated in heat exchanger 146, relative to the traditional heat exchanger 142, is minor in view of the simplicity of fabrication and reliability in operation that results from the one-pipe geometry.

Figure 7C:
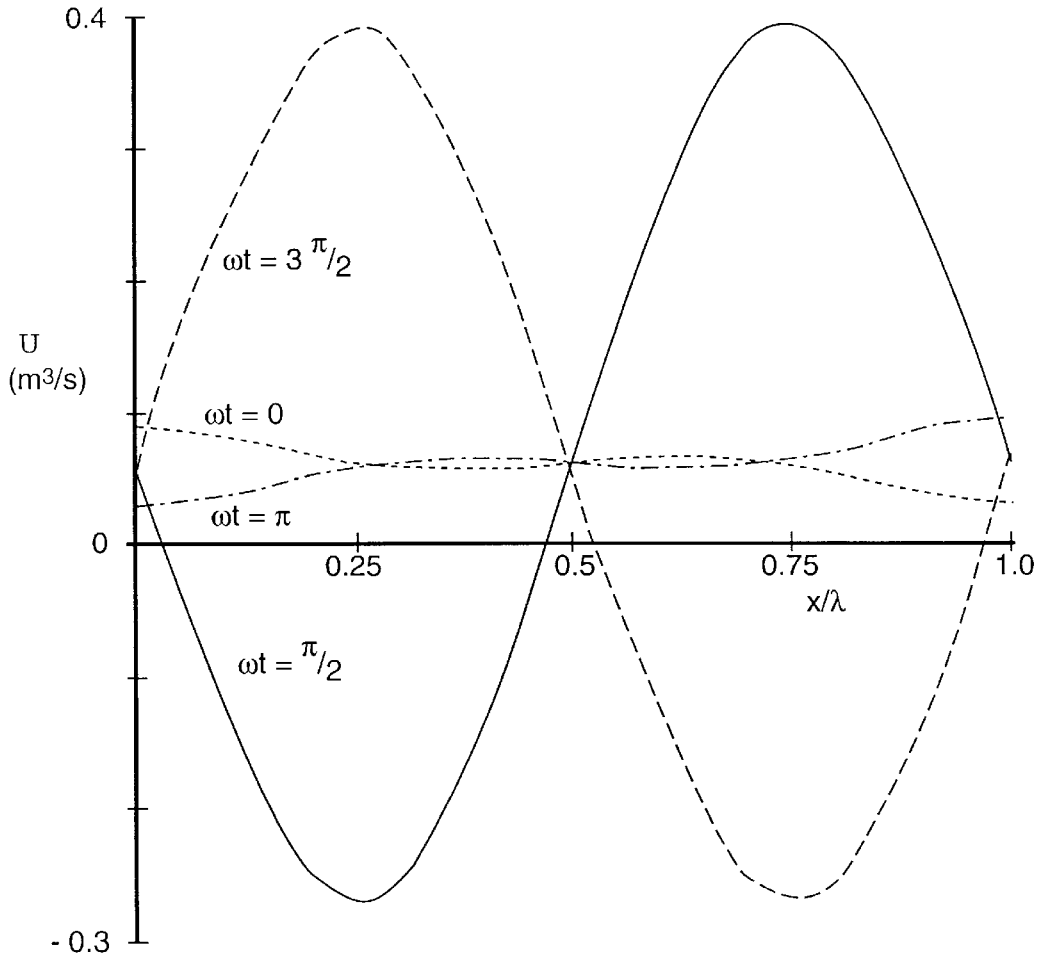
FIG. 7C graphically depicts the volume flow rate in one resonant circulating hot heat exchanger as a function of position and time.

The steady volume flow rate created in circulating heat exchanger 146 was 0.06 $m^3$/sec. The amplitude of the oscillating volume flow rate at the entrance and exit of circulating heat exchanger 146, where it is attached to trunk 145, was only 0.032 $m^3$/sec, while the amplitude of the oscillating volume flow rate along trunk 145 at that location was 0.5 $m^3$/sec. The amplitude of the oscillating volume flow rate in fluidic diodes 152, 154 was 0.33 $m^3$/sec. Qualitative features of some of these flow rates are shown in FIG. 7C, which shows the instantaneous volumetric flow rate U(x,t) as a function of position x in circulating heat exchanger 146 at four equally spaced times t in one cycle of the wave. The sign and origin of position coordinate x are shown in FIG. 7B, and the position x is normalized by wavelength $\lambda$ in FIG. 7C. The four equally spaced times are labeled by $\omega t$, where $\omega=2\pi f$ is the radian frequency of the oscillations and f is the frequency of the oscillations. Hence, $\omega t=2\pi$ represents a full temporal cycle of the oscillations. The zero of time has been chosen to be when the oscillating pressure in trunk 145 reaches a maximum. This oscillating pressure creates the entire wave U(x,t), with the amplitude of U largest at $x/\lambda=0.25$ and 0.75 where fluidic diodes 154, 152 induce the temporally steady and spatially uniform volume flow rate, here 0.06 $m^3$/s, Thus, a substantial steady flow rate is created through a heat exchanger with a very large surface area, while consuming a relatively small amount of oscillating flow from the trunk, and this is accomplished with no moving parts.

It will be appreciated by those skilled in the art that acoustic power at such a high temperature is inherently less valuable than acoustic power at ambient temperature, according to the principles of exergy accounting in thermoacoustics (G. W. Swift, *Thermoacoustics: A unifying perspective for some engines and refrigerators*, supra). Thus the extra 4.9 kW of acoustic power consumed by the circulating heat exchanger appears even less important in this application.

The calculations described above were performed using a conventional design code for oscillating-wave engines and refrigerators, such as DeltaE (available at www.lanl.gov/thermoacoustics/) or Sage (available from Gedeon Associates, Athens, Ohio, dgedeon@compuserve.com). The estimation of the acoustic power consumed by the fluidic diodes, the steady pumping effect of the fluidic diodes, and the resulting steady flow is accomplished as follows. The time-averaged pressure difference $\overline{\Delta p_{fd}}$ developed across each fluidic diode due to the time-dependent flow through it can be estimated using $$\overline{\Delta p_{fd}} = \frac{\omega}{2\pi A^2}\left[\int_{t_1}^{\pi/\omega-t_1} K_{in}\frac{1}{2}\rho(|U_1|\sin\omega t + U_m)^2 dt - \int_{\pi/\omega-t_1}^{2\pi/\omega+t_1} K_{out}\frac{1}{2}\rho(|U_1|\sin\omega t + U_m)^2 dt\right] \quad \text{Eqn. 1}$$

where $K_{out}$ and $K_{in}$ are the minor loss coefficients for the two directions of flow through the fluidic diode, A is the area on which the K's are based (conventionally the smallest area of the fluidic diode), $\rho$ is the gas mass density, $|U_1|$ is the amplitude of the oscillating volumetric flow rate at the small diameter of the fluidic diode, $|U_m|$ is the steady volumetric flow rate, t is time, and $t_1$ is the time at which the volumetric flow rate crosses zero, i.e., $t_1$ satisfies $|U_1| \sin \omega t_1+U_m=0$ (where the solution with $-\pi/2<\omega t_1<0$ is chosen). Equation 1 is a straightforward extension of Equation 7.76 in G. W. Swift, *Thermoacoustics: A unifying perspective for some engines and refrigerators*, supra.

Assuming that $\rho$, $K_{out}$ and $K_{in}$ are independent of time, performing the integrals in Equation 1 and simplifying yields $$\overline{\Delta p_{fd}} = \frac{\rho|U_1|^2}{8A^2}(K_{out}-K_{in})\times \left\{(1+2\varepsilon^2) - \frac{K_{out}+K_{in}}{K_{out}-K_{in}}\frac{2}{\pi}\left[(1+2\varepsilon^2)\sin^{-1}\varepsilon + 3\varepsilon\sqrt{1-\varepsilon^2}\right]\right\} \quad \text{Eqn. 2}$$

where $\epsilon=U_m/|U_1|$. This equation is used to estimate the pressure difference developed across the fluidic diode.

A time-averaged pressure gradient also exists throughout the rest of the circulating heat exchanger because $U_m$ flows throughout the circulating heat exchanger. To estimate the total pressure difference $\Delta p_{hx}$ in the rest of the circulating heat exchanger, standard results of fluid mechanics are used (e.g., Fox and McDonald, supra), so that $$\Delta p_{hx} = k\frac{1}{2}\rho\left(\frac{U_m}{A_{hx}}\right)^2\frac{L}{D}, \quad \text{Eqn. 3}$$

where L is the total length, D is the diameter, $A_{hx}$ is the cross-sectional area, and k is the conventional Moody friction factor, which depends on Reynolds number and surface roughness.

Using Equations 2 and 3 and setting $\overline{\Delta p_{fd}}=\Delta p_{hx}$ allows $U_m$ to be found. This is done numerically because of the complicated nature of Equation 2.

The acoustic power consumed by each fluidic diode due to the time-dependent flow through it is estimated using $$\overline{\Delta \dot{E}_{2,fd}} = \frac{\omega}{2\pi A^2}\left[\int_{t_1}^{\pi/\omega-t_1} K_{in}\frac{1}{2}\rho(|U_1|\sin\omega t + U_m)^3 dt - \int_{\pi/\omega-t_1}^{2\pi/\omega+t_1} K_{out}\frac{1}{2}\rho(|U_1|\sin\omega t + U_m)^2 dt\right]. \quad \text{Eqn. 4}$$

Again assuming that $\rho$, $K_{out}$ and $K_{in}$ are independent of time, performing the integrals in Equation 4 and simplifying yields $$\overline{\Delta \dot{E}_{2,fd}} = \frac{\rho|U_1|^3}{3\pi A^2}(K_{out}+K_{in})\times\left\{\left(1+\frac{11}{4}\varepsilon^2\right)\sqrt{1-\varepsilon^2} + \frac{3}{4}\varepsilon(3+2\varepsilon^2)\sin^{-1}\varepsilon - \frac{K_{out}-K_{in}}{K_{out}+K_{in}}\left(\frac{9\pi\varepsilon}{8}+\frac{3\pi\varepsilon^3}{4}\right)\right\}, \quad \text{Eqn. 5}$$

which can be readily used.

The use of resonant circulating heat exchanger 168 as the cold heat exchanger in an orifice pulse tube refrigerator 160 has also been investigated for one application. FIG. 8A illustrates this case with a traditional shell-and-tube heat exchanger 162, and FIG. 8B illustrates the application with circulating heat exchanger 168, both having regenerator 164, pulse tube 166, and trunk 165. Again, the working gas was helium gas at an average pressure of 3.1 MPa, oscillating at 40 Hz. Refrigerator 160 was designed to provide 20 kW of cooling power at 100 K. The amplitude of the oscillating pressure in the helium in and near the heat exchanger 162 or 168 was 240 kPa.

Traditional heat exchanger 162, illustrated in FIG. 8A, comprised 5,500 tubes in parallel, each having a length of 1.5 inches and an inside diameter of 0.148 inch, so that the total surface area of metal in contact with the helium was 2.4 square meters. A total of 400 W of acoustic power was consumed in viscous and thermal hysteresis loss in heat exchanger 162.

The corresponding circulating heat exchanger 168 for this application is shown in FIG. 8B: pipe 172 one wavelength long, with two fluidic diodes 174, 176 at the quarter-wavelength positions. Pipe 172 had a length of 44 feet and a diameter of 2.4 inches, so that the total surface area presented to the helium was 2.5 square meters. The long length of circulating heat exchanger 168 means that some length can be devoted to tubing runs without heat exchange, in order to place the process fluid heat-transfer surfaces at a convenient location remote from regenerator 164, where the heat-exchange portion of pipe 172 can be coiled for compactness. Each of fluidic diodes 174, 176 was a truncated cone, with its large end matched to the pipe diameter and its small end having an area equal to 40% of that of the pipe, and with a length of 37 cm. The lip at the abrupt diametral transition from the small-diameter end back to the pipe diameter was generously rounded, as described above. The dissipation of acoustic power in this circulating heat exchanger was estimated to be 760 W. Even though the energy cost of this dissipation at low temperature is relatively high, the extra 360 W, relative to the traditional design described above, is again a minor performance penalty in view of the simplicity of fabrication and reliability in operation that results from the simple, one-pipe geometry as compared to the 5,500 small tubes of the traditional design.

The steady volume flow rate created in circulating heat exchanger 168 was 0.023 $m^3$/sec. The amplitude of the oscillating volume flow rate at the entrance and exit of circulating heat exchanger 168, where it is attached to trunk 165, was only 0.003 $m^3$/sec. Thus, a substantial steady flow rate is created through a heat exchanger with a large surface area, while consuming a relatively small amount of oscillating flow and of acoustic power, and this is accomplished with no moving parts and with a reduction by orders of magnitude in the number of joints that must be made leak tight during fabrication.

FIGS. 9A and 9B illustrate a non-resonant embodiment of the present invention, discussed here in the context of the hot heat exchanger of an oscillating-wave engine 180 having regenerator or stack 184, thermal buffer tubes 186 and 190 forming trunks 185, 195. FIG. 9A shows a portion of engine 180, employing a traditional shell-and-tube heat exchanger 182 with the helium working gas oscillating through the tubes and the steady flow of the combustion gases flowing through the shell. FIG. 9B shows the use of a non-resonant circulating hot heat exchanger 188 according to the present invention, instead of traditional hot heat exchanger 182. Non-resonant circulating hot heat exchanger 188 is a pipe network 192 with a length less than a quarter wavelength of sound in the gas in the pipe, at the frequency of the oscillation of the working gas in engine 180, and having one or more (two are shown in FIG. 7B) fluidic diodes 194, 196 in the pipe. The oscillating and, steady flows of the working gas, and the steady flow of the process fluid (here, a hot gas such as the combustion products from a burner) are similar to those shown in FIG. 6. Fluidic diodes 194, 196 are located where the oscillating volume flow rate is a maximum, near the connections to trunk 195, so that fluidic diodes 194, 196 can create the largest possible steady flow. Heat exchanger passages 192 can be subdivided into several passages in parallel, as shown in FIG. 9B, although the number of passages can be considerably smaller than the number of passages in heat exchanger 182 shown in FIG. 9A.

Preliminary estimates were made for one specific design of this type for an engine, with hot circulating heat exchanger 188 connected between regenerator 184 above it and thermal buffer tube 190 below it, as shown schematically in FIG. 9B, but with only one fluidic diode. The engine was designed to operate at 40 Hz, with helium at an average pressure of 3.1 MPa and the amplitude of the oscillating pressure in the helium below the regenerator of 310 kPa.

The heat to be transferred from combustion gas to helium was 3 MW, keeping the hot, lower face of regenerator 184 at 936 K. This would be a large system. For example, the small diameter of the conical fluidic diode was chosen to be 40 cm, in order to accommodate an oscillating volume flow rate amplitude of 20 $m^3$/sec and to dissipate only 85 kW of acoustic power in the diode. The estimates showed that the fluidic diode would then pump a steady volumetric flow rate of 8 $m^3$/sec against a steady pressure head of 5 kPa, so the impedance of heat exchanger 188 was designed accordingly. One design of such a heat exchanger 188 then resulted in 75 kW of acoustic power dissipation in the heat exchanger, for a total acoustic power dissipation of 160 kW.

This acoustic power dissipation is acceptable because there is no prior-art way to build a hot heat exchanger for such a large oscillating-wave engine. A traditional heat exchanger design was not even considered since the fabrication of such a large traditional heat exchanger for this application did not appear feasible. No oscillating-wave engine has ever been built with such a large power.

For non-resonant circulating heat exchanger 188, the oscillating volume flow rate at each connection between circulating heat exchanger 188 and trunk 195 is larger than the steady volume flow rate, because no acoustic wave or resonance phenomena are used to increase the oscillations at the location(s) of the fluidic diode(s) relative to their amplitudes at the connections. Hence, getting a large enough steady volume flow rate requires an oscillating volume flow rate that is not insignificant relative to the oscillating volume flow rate in trunk 195. Therefore, to accommodate this increased oscillating volume flow rate, thermal buffer tube 190 must be enlarged, as shown in FIG. 9B.

In the oscillating-wave engines and refrigerators discussed above, the oscillating flows within a given regenerator or stack are essentially parallel, such as through the short dimension of a regenerator shaped with the proportions of a hockey puck. However, the same principles apply to oscillating-wave engines and refrigerators in which a stack or regenerator is shaped like a cylindrical annulus, with the, oscillating flow in the radial direction and to other geometries as well.

The discussion has focused on fluidic diodes having no moving parts, but fluidic diodes with moving parts, such as check valves or any other means of partially or fully rectifying oscillating flow, can also be employed. The discussion has focused on one or two fluidic diodes used per heat exchanger, but more can be employed if a greater steady volume flow rate is desired. The fluidic diodes are best placed at locations of large oscillating volume flow rate, but the location need not be exactly at the relative maxima of the oscillating volume flow rate as described in the context of FIGS. 6B and 7B.

The discussion of the resonant circulating heat exchanger described a pipe length of one wavelength, but other lengths can accomplish the same resonant conditions leading to low oscillating flow rate at the connections between the pipe and the trunk, high oscillating flow rate at the location(s) of fluidic diode(s), and large surface area. Obviously two or a larger integer number of wavelengths would perform in a similar manner, albeit with increased losses. Acousticians also appreciate that variations in the cross section of the pipe along its length can be used to alter the oscillation amplitudes as functions of position in the pipe, with resulting total lengths of pipe either shorter or longer than a wavelength while still maintaining the important features.

The discussion has focused on only one circulating heat exchanger per engine or refrigerator, but obviously more than one can be employed. Two or more of the heat exchangers in an engine or refrigerator can be made according to the present invention. Also, two or more circulating heat exchangers, in parallel, according to the present invention can be employed as one heat exchanger if more heat transfer surface area is needed.

When the present invention is employed adjacent to a pulse tube or thermal buffer tube, it is preferable to employ means to ensure that the pulse tube or thermal buffer tube experiences substantially thermally stratified oscillating flow. Such means includes, e.g., flow straightener 155 spanning the cross sectional area of thermal buffer tube 150 at the end adjacent to circulating heat exchanger 146, as illustrated in FIG. 7B. Flow straightener 155 can have sufficient solid heat capacity to store heat during a fraction of the oscillation period, helping the heat transfer between circulating heat exchanger 146 and the nearby stack or regenerator 144.

Gravity-driven convection of the working gas in the circulating heat exchanger can also create steady flow, if the connections to the trunk and the parts of the circulating heat exchanger having thermal contact to the process fluid are at different heights. This feature can be useful in starting an engine using the present invention by providing convective heat transfer between the process fluid and the regenerator or stack before the oscillations begin.

The embodiments discussed herein are directed to oscillating-wave engines and refrigerators with few or no moving parts, but the invention is also well suited to oscillating-wave engines and refrigerators that depend on moving pistons, such as traditional Stirling engines and refrigerators. The resonant form of the invention is particularly well suited to such applications, because it does not require increased oscillating volume flow rate in the trunk and hence does not require increased piston motion.

The foregoing description of the invention has been presented for purposes of illustration and description and is not intended to be exhaustive or to limit the invention to the precise form disclosed, and obviously many modifications and variations are possible in light of the above teaching.

The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. In an oscillating-wave engine or refrigerator having a regenerator or a stack in which oscillating flow of a working gas occurs in a direction defined by an axis of a trunk of the engine or refrigerator, a heat exchanger comprising:

first and second connections branching from the trunk at locations along the axis in selected proximity to one end of the regenerator or stack, where the trunk extends in two directions from the locations of the connections;

a circulating heat exchanger loop connected to the first and second connections; and at least one fluidic diode within the circulating heat exchanger loop to produce a superimposed steady flow component and oscillating flow component of the working gas within the circulating heat exchanger loop;

wherein a local process fluid is in thermal contact with an outside portion of the circulating heat exchanger loop.

2. The heat exchanger of claim 1, wherein the circulating heat exchanger is sized so that the oscillating flow component has no local volume flow rate amplitude maxima in the circulating heat exchanger located at the first and second connections.

3. The heat exchanger of claim 2, wherein the at least one fluidic diode is located at a local volume flow rate amplitude maximum location.

4. The heat exchanger of claim 1, wherein the first and second connections are located at locations of minimal oscillating volume flow rate of the working gas in the circulating heat exchanger.

5. The heat exchanger of claim 4, wherein the at least one fluidic diode is located at a location of a local volume flow rate amplitude maximum.

6. In an oscillating-wave engine or refrigerator having a regenerator or a stack in which oscillating flow of a working gas occurs in a direction defined by an axis of a trunk of the engine or refrigerator, an improved heat exchanger comprising:

first and second connections branching from the trunk at locations along the axis in selected proximity to one end of the regenerator or stack, where the trunk extends in two directions from the locations of the connections;

a circulating heat exchanger loop connected to the first and second connections, wherein the length of the circulating heat exchanger loop is an integral number of wavelengths of the working gas at a temperature of the circulating heat exchanger loop; and at least one fluidic diode within the circulating heat exchanger loop to produce a superimposed steady flow component and oscillating flow component of the working gas in the circulating heat exchanger loop;

wherein a local process fluid is in thermal contact with an outside portion of the circulating heat exchanger loop.

7. The heat exchanger of claim 6, wherein the circulating heat exchanger is sized so that the oscillating flow component has no local volume flow rate amplitude maxima in the circulating heat exchanger located at the first and second connections.

8. The heat exchanger of claim 7, wherein the at least one fluidic diode is located at a local volume flow rate amplitude maximum location.

9. The heat exchanger of claim 6, wherein the first and second connections are located at location of minimal oscillating volume flow rate of the working gas in the circulating heat exchanger.

10. The heat exchanger of claim 9, wherein the at least one fluidic diode is located at a location of a local volume flow rate amplitude maximum.

* * * * *